US006561440B1

(12) United States Patent
Hofherr

(10) Patent No.: US 6,561,440 B1
(45) Date of Patent: May 13, 2003

(54) FULL CONE SPRAY NOZZLE FOR METAL CASTING COOLING SYSTEM

(75) Inventor: Christy Hofherr, Plainfield, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 09/992,729

(22) Filed: Nov. 14, 2001

(51) Int. Cl.[7] ..... B05B 1/34
(52) U.S. Cl. ..... 239/472; 239/494; 239/497
(58) Field of Search ..... 239/472, 497, 239/494, 491, 487, 463, 461

(56) References Cited

U.S. PATENT DOCUMENTS 2,428,748 A * 10/1947 Barz ..... 239/472
4,474,331 A * 10/1984 Aprea et al. ..... 239/497
4,669,667 A * 6/1987 Perkins et al. ..... 239/472
5,143,298 A 9/1992 Prokopoff
6,076,744 A 6/2000 O'Brien

* cited by examiner

*Primary Examiner*—Steven J. Ganey
(74) *Attorney, Agent, or Firm*—Leydig, Voit & Mayer, Ltd.

(57) ABSTRACT

A spray nozzle particularly useful for directing a liquid coolant onto continuously cast metal shapes. The spray nozzle includes a nozzle body having a liquid flow passageway communicating with a discharge orifice and a vane disposed within the passageway upstream of the discharge orifice. The vane has a central orifice for creating an axial flow stream and a plurality of circumferentially spaced angled passages for tangentially directing a plurality of liquid flow streams which create liquid turbulence, breakdown and intermixing with the axial flow stream such that liquid emitted from the discharge orifice is adapted for more uniform cooling of a cast metal notwithstanding changes in liquid pressure commensurate with changes in the rate at which the metal is cast.

19 Claims, 5 Drawing Sheets

FULL CONE SPRAY NOZZLE FOR METAL CASTING COOLING SYSTEM

FIELD OF THE INVENTION

The present invention relates generally to spray nozzles, and more particularly to full cone liquid spray nozzles having particular utility for spraying liquid coolants in metal casting operations.

BACKGROUND OF THE INVENTION

In metal casting operations, and particularly continuous metal casting systems in which steel slabs, billets, or other metal shapes are extruded from a mold, it is necessary to spray the emerging metal with water for rapid heat removal. It is desirable that the spray be finely atomized and uniformly directed onto the metal for uniform cooling. Uneven distribution of the liquid coolant results in non-uniform cooling of the metal, which can cause cracking, high stresses, and reduced surface and edge quality.

Full cone liquid spray nozzles have been used in continuous metal casting operations for directing cooling liquid, namely water, onto the metal surface for maximum cooling without dissolution by pressurized air. Prior full cone spray nozzles typically comprise a nozzle body having a discharge orifice and an upstream vane for imparting swirling movement to the liquid passing through the nozzle for breaking up the liquid flow and distributing liquid particles throughout the discharging conical spray pattern. Prior full cone spray nozzles, however, have had operating drawbacks.

One problem with prior full cone liquid spray nozzles arises by reason of the liquid throughput being controlled entirely by the liquid pressure. To achieve proper cooling, the volume of liquid sprayed in a continuous casting operation must be commensurate with the rate at which the steel shape is cast. In other words, when the metal emerges from the mold at a higher rate, a greater quantity of coolant is required for proper cooling than during lower rate casting. In prior full cone spray nozzles, however, a change in liquid pressure necessary for changing the spray volume also changed the angle of the discharging conical spray, which in turn changed the spray coverage, i.e. the area on the metal surface upon which the liquid impinges. A change in the spray coverage, in turn, can alter the uniformity in cooling by changing the extent discharging sprays of adjacent nozzles overlap, and in some cases, causing gaps between the discharging sprays of adjacent nozzles.

A further problem with the use of prior full cone liquid spray nozzles in continuous metal casting operations is that the discharging spray, regardless of spray pressure, is inherently non-uniform. Tests demonstrate that the volume of liquid collected per unit area (i.e. liquid density) along one narrow planar segment parallel to the axis of the spray nozzle varies substantially from the liquid density taken in a second narrow planar segment through the nozzle axis perpendicular to the first. While such non-uniformity might be taken into account if the spray nozzles could be mounted in predetermined relation to each other, typically the spray nozzles are simply screwed onto a supply pipe such that the irregular spray pattern of one nozzle has no relation to the irregular spray pattern of an adjacent nozzle, which can result in further non-uniformity in cooling of a moving cast metal.

OBJECTS AND SUMMARY OF THE INVENTION

It is an object of the present invention to provide a cast metal liquid spray system having full cone liquid spray nozzles adapted for more uniform liquid spraying, and hence, more uniform cooling of the metal.

Another object is to provide a full cone liquid spray nozzle in which the liquid spray volume of the discharging spray may be readily changed, according to the speed of the metal casting operation, without adversely affecting uniformity in cooling.

A further object is to provide a full cone spray nozzle as characterized above in which the discharging conical spray angle, and hence spray coverage, is substantially unaffected by changes in liquid pressure.

Yet another object is to provide a full cone liquid spray nozzle of the above kind in which liquid density in the discharging spray is substantially similar throughout the spray pattern, including planar segments through the axis of the nozzle perpendicular to each other.

Still another object is to provide a full cone liquid spray nozzle of the foregoing type which is relatively simple in construction and which lends itself to economical manufacture and reliable use.

Other objects and advantages of the invention will become apparent upon reading the following detailed description and upon reference to the drawings, in which:

Figure 1:
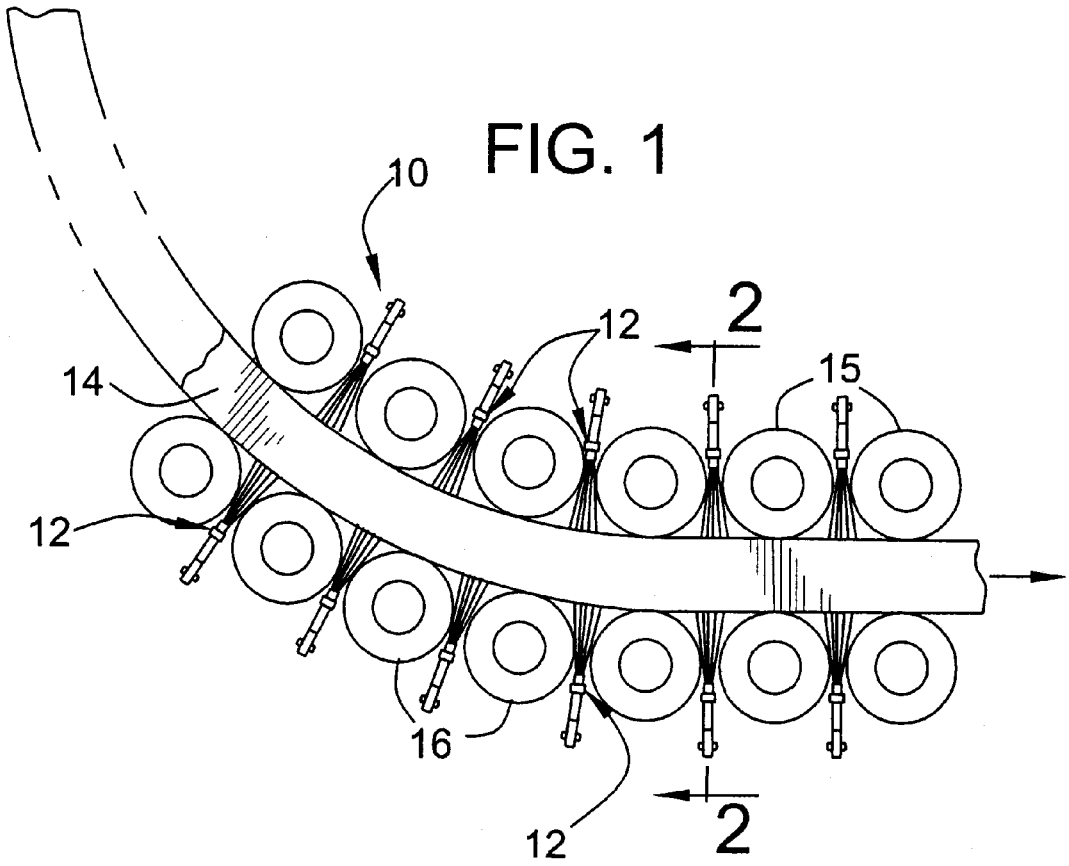
FIG. 1 is a side elevational view of a continuous casting apparatus having a spraying system with spray nozzles in accordance with the present invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative continuous metal casting apparatus having a spraying system 10 with full cone liquid spray nozzles 12 embodying the invention. The continuous casting apparatus may be of a known type, including a continuous casting mold (not shown) from which a metal shape, in this instance in the form of slab 14, is extruded. The slab 14 in this case emerges from the continuous caster and is transitioned from the vertical to a horizontal orientation, by means of parallel sets of guide rollers 15, 16 rotatably supported on opposite sides of the emerging metal shape. A plurality of the spray nozzles 12 are supported in respective rows between each pair of rollers 15, 16 for directing a conical liquid spray, namely water, onto opposite surfaces of the metal shape 14. As is known in the art, the spray nozzles 12 in each row are supported by a common liquid manifold supply pipe 17 and are mounted such that the discharging spray patterns of adjacent spray nozzles assemblies overlap slightly so that the face of the moving metal shape is cooled as evenly as possible. Since each spray nozzle 12 is similar in construction, only one need be described in detail.

Figure 3:
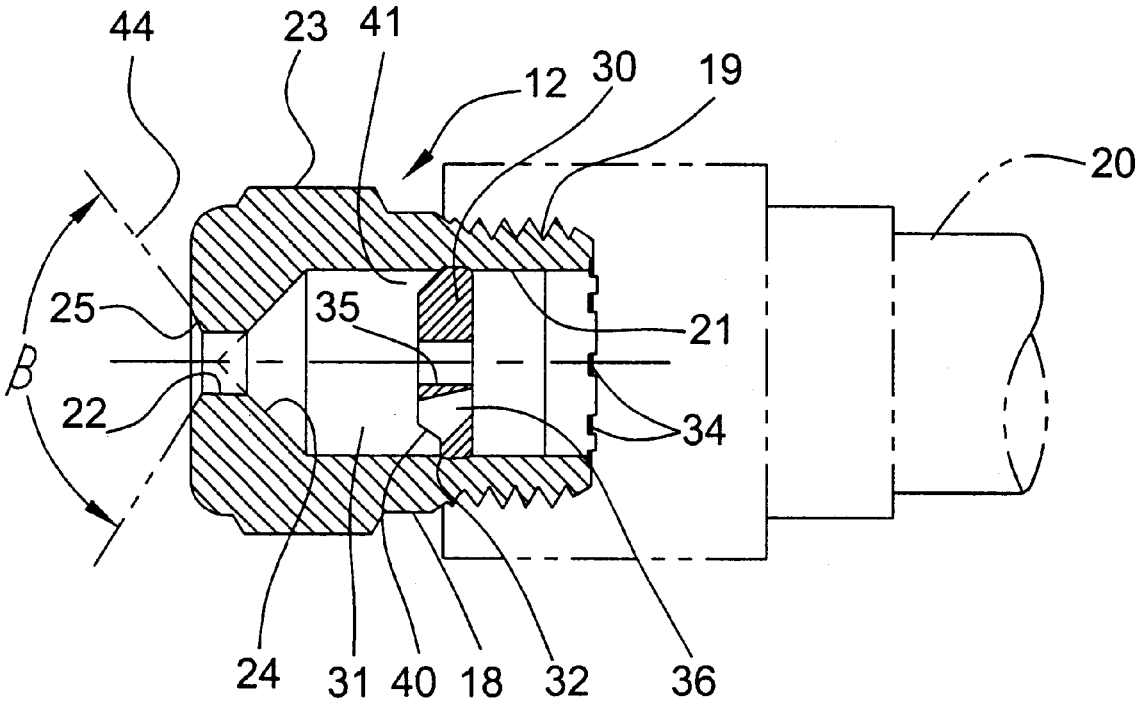
FIG. 3 is an enlarged longitudinal section of one of the spray nozzles of the illustrated spraying system.
Figure 4:
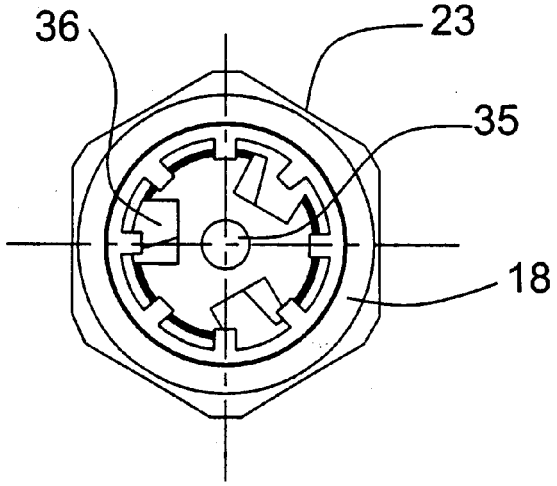
FIG. 4 is a plan view of an upstream end of the spray nozzle shown in FIG.3.
Figure 6:
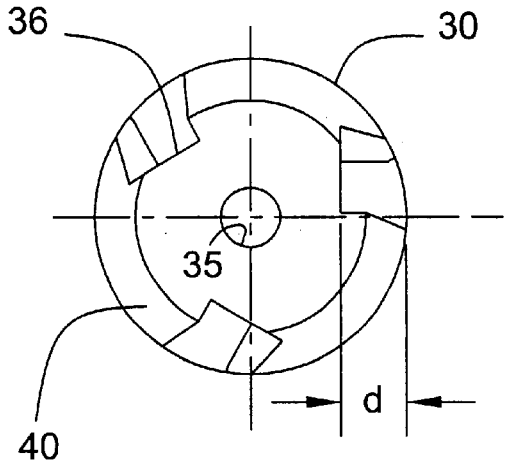
FIG. 6 is a plan view of a downstream end of the vane shown in FIG. 5.
Figure 5:
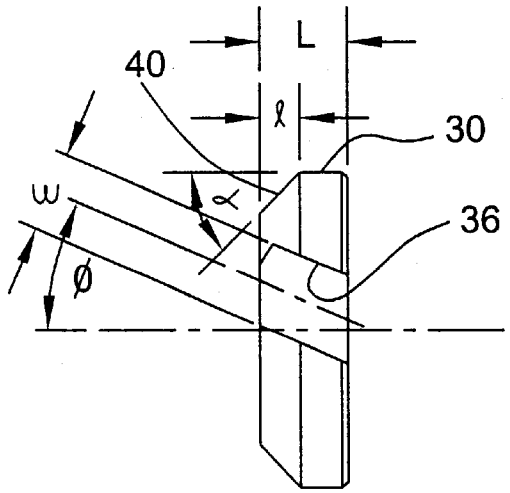
FIG. 5 is an enlarged side elevational view of the whirl imparting vane of the spray nozzle shown in FIG. 3.

Each spray nozzle 12, as depicted in FIG. 3, comprises an elongated hollow body 18 having an externally threaded end 19 for connection to a supply line or pipe 20, which in turn typically connects upstream to the supply manifold for the row of the spray nozzle assemblies. A hex head 23 is formed adjacent a downstream end of the nozzle body 18 for facilitating wrench tightening of the nozzle body 18 with a coupling for the supply pipe 20. The nozzle body 18 has an axial liquid passageway 21 communicating with the liquid supply pipe 20 and a circular discharge orifice 22 at a downstream end of the nozzle body. The discharge orifice 20 in this case is cylindrically configured with an inwardly converging frustoconical inlet section 24 and a relatively small outwardly extending frustoconical section 25 at the exit end.

For imparting a swirling movement to liquid passing through the nozzle body 18 and for breaking the liquid up into particles which are distributed throughout a full cone liquid spray pattern emitted from the discharge orifice 22, a vane 30 is provided in the passageway 21 intermediate the upstream end of the nozzle body 18 and the discharge orifice 22. The vane 30 in this case is a separate member or insert press fit within the liquid passageway 21. For ensuring predetermined longitudinal positioning of the vane 30 upstream of the discharge orifice 22 such that the passageway 21 defines a substantially cylindrical whirl and mixing chamber 31 between the vane 30 and discharge orifice 22, the passageway 21 is formed with a small counter bore that defines a locating seat 32 against which the vane 30 is positioned. To prevent accidental displacement of the vane 30 from the nozzle body 18 in the event it might become loosened, the nozzle body 18 is formed with inwardly directed radial detents 34 about the upstream end of the inlet passage 21.

In accordance with the invention, the nozzle vane has a unique construction which facilitates liquid breakdown and substantial uniform distribution of liquid throughout a discharging full cone spray pattern for enhanced uniformity in cooling of moving metal shapes in continuous casting operations. To this end, the vane 30 has a central axial passageway 35 for permitting passage of a central portion of the liquid throughput and at least three angled passageways 36 for creating a plurality of tangentially directed flow streams for intermixing with the central flow stream. The illustrated vane 30 has a central passage 35 in the form of a cylindrical opening extending axially through the vane and three angled passageways 36 which are circumferentially spaced 120° about the periphery of the vane. The angled passageways 36 in this instance are defined by outwardly opening rectangular or U-shaped slots formed in the outer periphery of the vane 30. For imparting a tangential direction to the liquid passing through the angled flow passages 36, the angled passages 36 each have an exit angle Ø of about 25° relative to the longitudinal axis of the spray nozzle. To facilitate manufacture, the slots that define the angled passageways 36 extend in straight fashion through the vane at a constant angle $\phi$ relative to the longitudinal axis.

In the illustrated vane 30, the angled passageways 36 have a width "w" slightly greater than the depth "d." Preferably the width "w" of the angled vane passageways is about 1.2 times the depth "d." The angled vane passageways 36 also each preferably define a flow area of between about 0.19 and 0.26 the area of the central vane passage 35, and preferably each have a flow area between about 0.2 and 0.25 the flow area of the central vane passageway 35. Preferably the discharge orifice 22 of the nozzle body 18 has a flow area between about 2.0 and 2.3 the flow area of the central vane passageway 35. While the illustrated vane has three angled passageways 36, alternatively the vane could have four or more proportionately smaller angled passageways depending on the size of the nozzle body 18 and any solid materials in the cooling liquid that could cause potential clogging.

In keeping with the invention, to facilitate liquid breakdown and intermixture within the whirl and mixing chamber 31, the vane 30 has an inwardly tapered, frustoconical downstream end 40 such that each angled passageway 36 discharges liquid in part into a tapered chamber 41 that expands in a downward direction defined by the inwardly tapered end 40 of the vane 30 and the surrounding cylindrical wall of the whirl and mixing chamber 31. The frustoconical end 40 of the vane in this instance has an angle a of 45° and an axial length "1" of about ½ the length "L" of the vane. For reasons not fully understood, the liquid flow streams discharging from the plurality of angled passageways 31 into the tapered annular chamber 41 incur enhanced liquid particle breakdown and intermixing with the flow stream discharging from the central vane passageway 35 prior to channeling into and through the discharge orifice 22.

Figure 2:
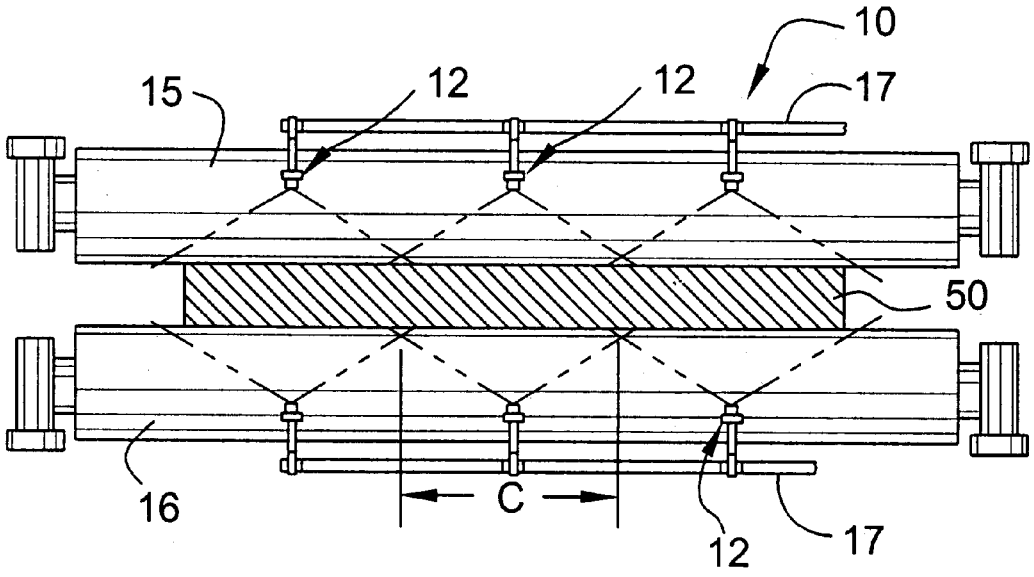
FIG. 2 is a transverse section taken in the plane of line 2—2 in FIG. 1.

In operation of the spraying system 11, pressurized liquid directed into the inlet passage 21 of the nozzle body 18 will pass through the vane 30, with a portion being axially directed through the central passage 35 and a plurality of flow streams being tangentially directed through the angled passageways 36. The plurality of liquid flow streams breakdown and intermix in the mixing chamber 31 for subsequent discharge from the discharge orifice 22 in a full cone liquid spray pattern 44 with liquid spray particles distributed throughout the spray pattern. In the illustrated embodiment, the liquid discharges in conical spray pattern 44 having a conical spray angle $\beta$, such as between of 65° and 75°, which impinges upon an area "c" i.e., the coverage area, of the emerging cast metal shape, as depicted in FIG. 2. As indicated previously, the spray nozzles 12 are arranged such that the spray coverage area "c" of adjacent nozzles partially overlap each other.

Figure 7:
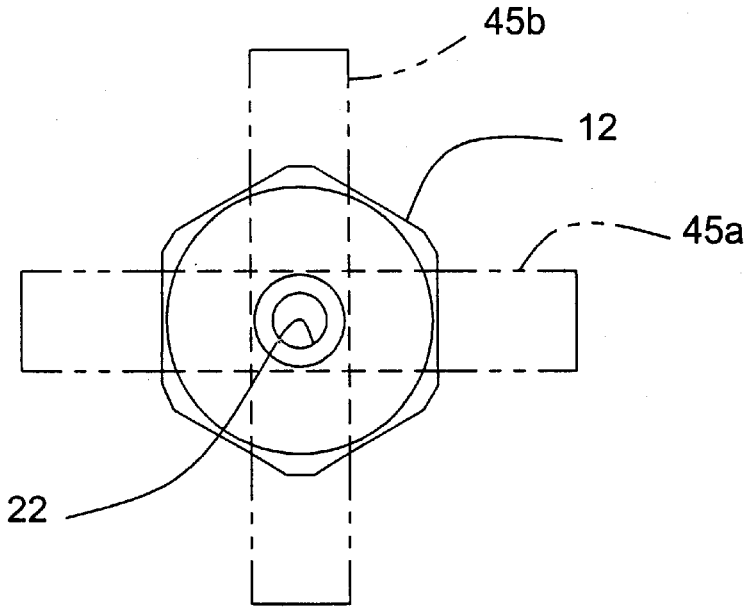
FIG. 7 is a plan view of a downstream end of the illustrated nozzle, illustrating linear segments through the axis of the nozzle within which discharging spray is collected for analytical evaluation.
Figure 8:
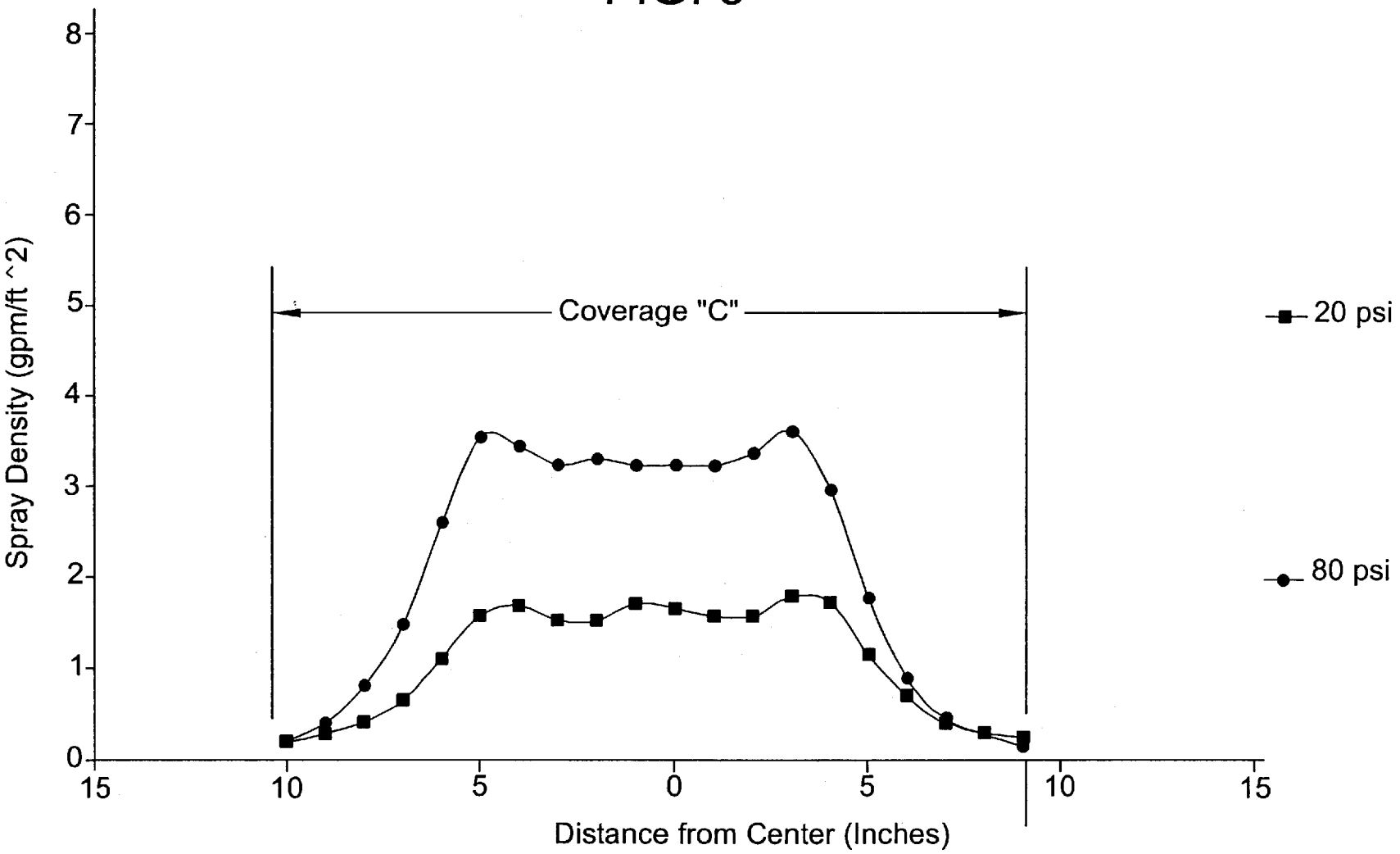
FIG. 8 is a graph comparing the flow liquid flow per unit area (spray density) and coverage of the discharging spray from the illustrated nozzle when operated at different liquid pressures.

In keeping with the invention, the volume of liquid directed from the spray nozzle may be readily adjusted by changing the liquid inlet pressure within a significant pressure range without affecting the spray angle $\beta$ of the discharging conical spray, and hence without substantially altering the coverage area "c" of the discharging spray, namely the area upon which the discharging spray impinges upon the metal surface. The conical spray angle $\beta$ of the discharging conical spray, and in turn the spray coverage "c," remains substantially unchanged notwithstanding substantial changes in the inlet liquid pressure. FIG. 8, for example, shows that the flow volume per unit area, i.e. spray density, for a spray nozzle embodying the present invention when operated at liquid pressures of 20 psi and 80 psi. The liquid in this case was collected in a planar segment 45*a* through the axis of the nozzle (see FIG. 7) It can be seen that when operated at increased liquid pressure, greater spray density is generated than when operated at a lower liquid inlet pressure, while the coverage area "c" of the discharging conical spray is substantially identical at both pressures.

Figure 9:
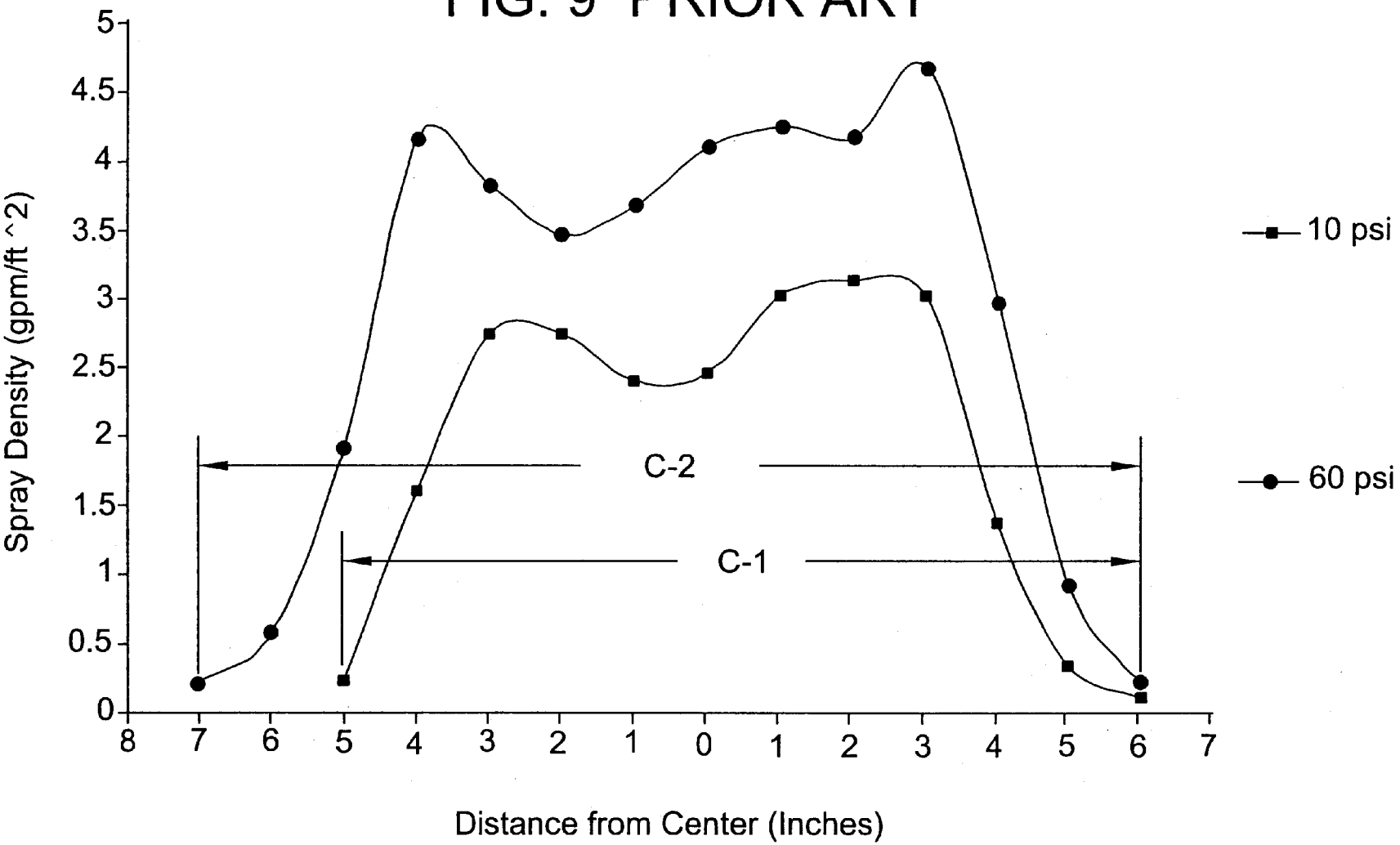
FIG. 9 PRIOR ART
FIG. 9 is a graph comparing the spray densities and coverage of discharging spray from a prior art full cone liquid spray nozzle when operated at different liquid pressures.

In contrast, FIG. 9 depicts performance of a prior art full cone pray nozzle Model ¼ HHX-8 Full Jet heretofore sold by applicant. While spray density increases with increased liquid pressure, the spray coverage "c-1" for the spray nozzle when operated at 10 psi is substantially less than the spray coverage "c-2" when the nozzle is operated at 60 psi. As a result, when the spray nozzle is operated at such lower liquid pressure, the overlap of the spray coverage of adjacent nozzles is substantially less than that during higher liquid pressure operation, and depending upon the spacing of the spray nozzles, can result in undesirable gaps between the spray coverages of adjacent spray nozzles. In either case, uniformity in cooling can be adversely affected.

In further keeping with the invention, the liquid distribution of the discharging conical spray of the nozzle 12 of the present invention is substantially similar throughout the spray pattern. FIG. 8, for example, depicts the flow per unit area or spray density taken in a relatively narrow planar segment 45*a* (see FIG. 7) through the axis of the spray nozzle. Tests indicate that the liquid distribution of the conical spray in a planar segment 45*b* (FIG. 7) through the axis of the nozzle perpendicular to the planar segment 45*a* is substantially identical. In other words, the distribution remains similar throughout the spray pattern, notwithstanding the angular orientation of the planar segment. Hence, the nozzle assembly may be screwed on the liquid supply pipe, with liquid distribution of adjacent nozzles being substantially similar, regardless of the screwed on rotational position of the nozzle body relative to the supply line.

In contrast, applicant's aforementioned prior art ¼ HHX-8 Full Jet nozzle, when operated at 60 psi, produces a liquid distribution in a first planar segment taken through the axis of the nozzle body that varies substantially with respect to the liquid distribution taken through a second planar segment through the axis of the nozzle body perpendicular to the first. Non-uniformity in resulting cooling from such spray nozzles is particularly significant when adjacent nozzles are screwed on their respective supply pipe at different rotational positions with respect to the supply pipe.

From the foregoing, it can be seen that the spraying system of the present invention is adapted for more uniform and effective cooling of metal shapes in continuous casting operations, giving better surface and edge quality to the cast metal. The spray volume through the liquid spray nozzles, furthermore, can be readily changed, by changing the liquid inlet pressure, without adversely affecting uniformity in cooling. The spray nozzle assemblies further generate substantially similar spray patterns, including substantially similar liquid density or distribution patterns in planar segments through the axis of the nozzle disposed perpendicularly relative to each other. It further will be understood by persons skilled in the art that the spray nozzle is relatively simple in construction and lends itself to economical manufacture and reliable usage.

What is claimed is:

1. A full cone liquid spray nozzle comprising:

a nozzle body having a discharge orifice at a downstream end and an inlet at an upstream end for connection to a liquid supply, a liquid flow passageway through said body communicating between said inlet and said discharge orifice, a vane disposed within said passageway upstream of said discharge orifice, said liquid flow passageway defining a whirl and mixing chamber between said vane and said discharge orifice, said vane having a frustoconical downstream end and a central orifice extending through said vane coaxial with said discharge orifice for creating and directing an axial flow stream, and said vane having at least three angled passages circumferentially disposed about said central orifice for tangentially directing a plurality of liquid flow streams which creates liquid turbulence, breakdown, and intermixing with said axial flow stream such that liquid emitted from said discharge orifice has a conical spray pattern with liquid particles distributed throughout the spray pattern.

2. The spray nozzle of claim 1 in which said nozzle body discharge orifice has a circular configuration.

3. The spray nozzle of claim 1 in which said vane is a separate insert member fixed within said liquid passageway.

4. The spray nozzle of claim 1 in which said angled passages communicate at least in part through said frustoconical downstream end of said vane.

5. The spray nozzle of claim 1 in which said body passageway and the frustoconical downstream end of said vane defines an outwardly expanding annular chamber communicating with said whirl chamber into which said angled passageways discharge liquid.

6. The spray nozzle of claim 5 in which said frustoconical end of the vane extends an axial length about one-half the axial length of the vane.

7. The spray nozzle of claim 1 in which said nozzle body discharge orifice has an inwardly converging frustoconical inlet section communicating with whirl chamber and an outwardly extending frustoconical section at a downstream end.

8. A full cone liquid spray nozzle comprising:

a nozzle body having a discharge orifice at a downstream end and an inlet at an upstream end for connection to a liquid supply, a liquid flow passageway through said body communicating between said inlet and said discharge orifice, a vane disposed within said passageway upstream of said discharge orifice, said liquid flow passageway defining a whirl and mixing chamber between said vane and said discharge orifice, said vane having a central orifice coaxial with said discharge orifice for creating an axial flow stream and at least three angled passages circumferentially disposed about said central orifice for tangentially directing a plurality of liquid flow streams which creates liquid turbulence, breakdown, and intermixing with said axial flow stream such that liquid emitted from said discharge orifice has a conical spray pattern with liquid particles distributed throughout the spray pattern, said angled passages each having a predetermined width "w" and radial depth "d," and said width "w" of said angled passage being greater than the depth "d" of said angled passage.

9. The spray nozzle of claim 8 in which said angled passages are equally spaced at 120° circumferential positions about the vane.

10. The full cone spray nozzle of claim 9 in which said angled passages each have a generally U-shaped cross section.

11. The spray nozzle of claim 8 in which said angled passages extend straight through the vane.

12. The spray nozzle of claim 8 in which said angled passages each have a width "w" that is about 1.2 times the depth "d".

13. A full cone liquid spray nozzle comprising:

a nozzle body having a discharge orifice at a downstream end and an inlet at an upstream end for connection to a liquid supply, a liquid flow passageway through said body communicating between said inlet and said discharge orifice, a vane disposed within said passageway upstream of said discharge orifice, said liquid flow passageway defining a whirl and mixing chamber between said vane and said discharge orifice, said vane having a central orifice coaxial with said discharge orifice for creating an axial flow stream and at least three angled passages circumferentially disposed about said central orifice for tangentially directing a plurality of liquid flow streams which creates liquid turbulence, breakdown, and intermixing with said axial flow stream such that liquid emitted from said discharge orifice has a conical spray pattern with liquid particles distributed throughout the spray pattern, and said angled passages each defining a flow area of between about 0.19 and 0.26 times the flow area of said central vane orifice.

14. A full cone liquid spray nozzle comprising:

a nozzle body having a discharge orifice at a downstream end and an inlet at an upstream end for connection to a liquid supply, a liquid flow passageway through said body communicating between said inlet and said discharge orifice, a vane disposed within said passageway upstream of said discharge orifice, said liquid flow passageway defining a whirl and mixing chamber between said vane and said discharge orifice, said vane having a central orifice coaxial with said discharge orifice for creating an axial flow stream and at least three angled passages circumferentially disposed about said central orifice for tangentially directing a plurality of liquid flow streams which creates liquid turbulence, breakdown, and intermixing with said axial flow stream such that liquid emitted from said discharge orifice has a conical spray pattern with liquid particles distributed throughout the spray pattern, and said nozzle body discharge orifice defining a flow area between about 2.0 and 2.3 times the flow area defined by said central vane orifice.

15. A spraying system for directing a coolant liquid in a metal casting apparatus comprising a plurality of spray nozzles disposed in side-by-side relation to each other, each nozzle being operable for directing a conical spray pattern of cooling liquid onto a coverage area of a metal surface to be cooled with the coverage areas of discharge sprays of adjacent nozzles being in partially overlapping relation to each other, said nozzles each comprising a nozzle body having a circular discharge orifice at a downstream end, a liquid flow passageway through said body communicating between a liquid inlet at an upstream end of said body and said discharge orifice, a vane disposed within said passageway upstream of said discharge orifice, said liquid flow passageway defining a whirl and mixing chamber between said vane and said discharge orifice, said vane having a frustoconical downstream end, a plurality of liquid flow passages including at least three angled passages circumferentially disposed about the vane which communicate at least in part through said frustoconical downstream end of said vane for tangentially directing a plurality of liquid flow streams into said whirl and mixing chamber such that liquid emitted from said discharge orifice has a conical spray pattern with liquid particles distributed throughout the spray pattern, a liquid supply for directing pressurized coolant liquid to said nozzles at different pressures within a predetermined pressure range depending upon volume of liquid to be sprayed by said spray nozzles for a particular cooling application, and said spray nozzles each being effective for discharging a conical spray pattern at a constant conical spray angle for impingement upon a constant coverage area notwithstanding changes in liquid pressure within said predetermined pressure range.

16. The spray nozzle of claim 15 in which said angled passages extend straight through the vane.

17. The spraying systems of claim 15 in which said vane liquid flow passages includes a central orifice coaxial with said discharge orifice for creating an axial flow stream for intermixing with the plurality of flow streams tangentially projected by said angled passages.

18. A spraying system for directing a coolant liquid in a metal casting apparatus comprising a plurality of spray nozzles disposed in side-by-side relation to each other, each nozzle being operable for directing a conical spray pattern of cooling liquid onto a coverage area of a metal surface to be cooled with the coverage areas of discharge sprays of adjacent nozzles being in partially overlapping relation to each other, said nozzles each comprising a nozzle body having a discharge orifice at a downstream end, a liquid flow passageway through said body communicating between a liquid inlet at an upstream end of said body and said discharge orifice, a vane disposed within said passageway upstream of said discharge orifice, said liquid flow passageway defining a whirl and mixing chamber between said vane and said discharge orifice, said vane having a frustoconical downstream end and a central orifice extending through said vane coaxial with said discharge orifice for creating an axial flow stream, and said vane having a plurality of angled passages circumferentially about said central orifice for tangentially directing a plurality of liquid flow streams which creates liquid turbulence, breakdown, and intermixing with said axial flow stream such that liquid emitted from said discharge orifice has a conical spray pattern with liquid particles distributed throughout the spray pattern, a liquid supply for directing pressurized coolant liquid to said nozzles, and said spray nozzles being effective for discharging a conical spray pattern with the liquid flow per unit area in a first planar segment taken through the axis of the nozzle body substantially similar to the liquid flow per unit area in a second planar segment taken through the axis of the nozzle body perpendicular to the first planar segment coverage area notwithstanding changes in liquid pressure within said predetermined pressure range.

19. The spraying system of claim 18 in which said vane has at least three of said angled passages.

* * * * *